US009168569B2

(12) United States Patent
Wu et al.

(10) Patent No.: US 9,168,569 B2
(45) Date of Patent: Oct. 27, 2015

(54) CONTAINER RINSING SYSTEM AND METHOD

(75) Inventors: Rei-Young Amos Wu, Palatine, IL (US); Michael J. Mastio, Crystal Lake, IL (US)

(73) Assignee: Stokely-Van Camp, Inc., Chicago, IL (US)

( * ) Notice: Subject to any disclaimer, the term of this patent is extended or adjusted under 35 U.S.C. 154(b) by 773 days.

(21) Appl. No.: 13/417,944

(22) Filed: Mar. 12, 2012

(65) Prior Publication Data

US 2012/0247512 A1 Oct. 4, 2012

Related U.S. Application Data

(63) Continuation-in-part of application No. 12/255,153, filed on Oct. 21, 2008, now Pat. No. 8,147,616.

(60) Provisional application No. 60/981,571, filed on Oct. 22, 2007.

(51) Int. Cl.

| | |
|---|---|
| ***B08B 3/00*** | (2006.01) |
| ***B08B 1/04*** | (2006.01) |
| ***B08B 5/02*** | (2006.01) |
| ***B08B 9/30*** | (2006.01) |
| ***B08B 9/34*** | (2006.01) |

(52) U.S. Cl.

CPC ... *B08B 1/04* (2013.01); *B08B 5/02* (2013.01); *B08B 9/30* (2013.01); *B08B 9/34* (2013.01); *Y10T 137/0402* (2015.04)

(58) Field of Classification Search

None

See application file for complete search history.

(56) References Cited

U.S. PATENT DOCUMENTS

| | | | |
|---|---|---|---|
| 2,199,459 | A | 5/1940 | Herold |
| 2,610,894 | A | 9/1952 | Hall |
| 2,614,680 | A | 10/1952 | Eisenberg |
| 2,784,120 | A | 3/1957 | Hagedorn |

(Continued)

FOREIGN PATENT DOCUMENTS

| | | |
|---|---|---|
| JP | 2007106438 | 4/2007 |
| JP | 2002255123 | 9/2009 |

(Continued)

OTHER PUBLICATIONS

International Search Report and Written Opinion for PCT/US2013/030171 dated May 17, 2013, 15 pages.

(Continued)

*Primary Examiner* — Eric Golightly

(74) *Attorney, Agent, or Firm* — James R. Gourley; Brandon V. Zuniga; Carstens & Cahoon, LLP

(57) ABSTRACT

A container rinsing system has a nozzle adapted to be positioned proximate an opening of the container and adapted to direct a supply of air in any orientation to the container. A vacuum member is positioned around the air nozzle and adapted to vacuum foreign particles away from the container. A system comprises an air source and a manifold having a manifold inlet, an ionization unit, and a plurality of manifold outlets along with a plurality of air nozzles. Each nozzle has a nozzle inlet, a nozzle outlet, and a nozzle passageway extending between the nozzle inlet and the nozzle outlet. The ionization unit is placed within the manifold, and the plurality of nozzles are located on the plurality of manifold outlets such that during operation air is ionized before entering the nozzles. The ionized air is used to clean containers.

8 Claims, 9 Drawing Sheets

(56) References Cited

U.S. PATENT DOCUMENTS

| | | | |
|---|---|---|---|
| 2,980,938 | A | 4/1961 | Whelan |
| 3,058,276 | A | 10/1962 | Palma |
| 3,071,497 | A | 1/1963 | Hinson |
| 3,428,257 | A | 2/1969 | Kentfield |
| 3,458,137 | A | 7/1969 | Behr |
| 3,677,273 | A | 7/1972 | Mahlstede |
| 3,801,020 | A | 4/1974 | Mocarski |
| 3,955,588 | A | 5/1976 | Born |
| 4,017,330 | A | 4/1977 | Aidlin |
| 4,097,000 | A | 6/1978 | Derr |
| 4,104,081 | A | 8/1978 | Totten |
| 4,180,105 | A | 12/1979 | Harvey |
| 4,207,286 | A | 6/1980 | Gut Boucher |
| 4,208,761 | A | 6/1980 | Ionescu |
| 4,313,767 | A | 2/1982 | Bemis |
| 4,385,728 | A | 5/1983 | Inglis |
| 4,459,483 | A | 7/1984 | Oikari |
| 4,483,435 | A | 11/1984 | Ionescu |
| 4,635,662 | A | 1/1987 | Totten |
| 4,667,690 | A | 5/1987 | Hartnig |
| 4,727,614 | A | 3/1988 | Swistun |
| 4,883,542 | A | 11/1989 | Voneiff |
| 4,982,768 | A | 1/1991 | Ahlers |
| 4,987,630 | A | 1/1991 | Allen |
| 5,076,303 | A | 12/1991 | McBrady |
| 5,129,212 | A | 7/1992 | Duffey |
| 5,145,297 | A | 9/1992 | McGrath, Jr. |
| 5,159,960 | A | 11/1992 | Pringle |
| 5,238,503 | A | 8/1993 | Phenix et al. |
| 5,265,298 | A | 11/1993 | Young |
| 5,279,017 | A | 1/1994 | Foreshew |
| 5,295,523 | A | 3/1994 | Gentile |
| 5,325,020 | A | 6/1994 | Campbell |
| 5,351,354 | A | 10/1994 | Hasumi |
| 5,363,866 | A | 11/1994 | Egger |
| 5,464,483 | A | 11/1995 | Avelis |
| 5,487,200 | A | 1/1996 | Herzog |
| 5,546,631 | A | 8/1996 | Chambon |
| 5,598,316 | A | 1/1997 | Kasting, Jr. |
| 5,700,327 | A | 12/1997 | Babacz |
| 5,862,840 | A | 1/1999 | Hansen |
| 5,881,429 | A | 3/1999 | Drewitz |
| 5,896,899 | A | 4/1999 | Schmitz |
| 5,911,249 | A | 6/1999 | Sanfilippo |
| 5,942,045 | A | 8/1999 | Raghavan |
| 6,026,867 | A | 2/2000 | Klarl |
| 6,065,683 | A | 5/2000 | Akin |
| 6,173,827 | B1 | 1/2001 | Carey |
| 6,189,292 | B1 | 2/2001 | Odell |
| 6,209,705 | B1 | 4/2001 | Drewitz |
| 6,332,484 | B1 | 12/2001 | Stahlecker |
| 6,334,472 | B1 | 1/2002 | Lemke |
| 6,431,227 | B1 | 8/2002 | Ter Haar |
| 6,457,497 | B1 | 10/2002 | Adriansens |
| 6,627,163 | B1 | 9/2003 | Awakowicz |
| 6,670,607 | B2 | 12/2003 | Wood |
| 6,691,747 | B1 | 2/2004 | Marcus |
| 6,752,959 | B2 | 6/2004 | Smith |
| 6,761,191 | B2 | 7/2004 | Rosen |
| 6,786,249 | B2 | 9/2004 | Armbruster |
| 7,243,865 | B2 | 7/2007 | Jarchau |
| 7,360,724 | B2 | 4/2008 | Willey |
| 7,487,568 | B2 | 2/2009 | Cirette |
| 7,621,301 | B2 | 11/2009 | Wu |
| 2002/0014276 | A1 | 2/2002 | Clusserath |
| 2003/0115710 | A1 | 6/2003 | Choi |
| 2003/0198570 | A1 | 10/2003 | Asahara |
| 2006/0117708 | A1 | 6/2006 | Thielmann |
| 2007/0240784 | A1 | 10/2007 | Wu |
| 2009/0101178 | A1 | 4/2009 | Wu |
| 2009/0158537 | A1 | 6/2009 | Ishijima |
| 2009/0266923 | A1 | 10/2009 | Gardner |
| 2010/0072311 | A1 | 3/2010 | Tanaka |
| 2010/0088830 | A1 | 4/2010 | Takayanagi |
| 2010/0163653 | A1 | 7/2010 | Pucciani |
| 2010/0200020 | A1 | 8/2010 | Gmeiner |
| 2010/0327077 | A1 | 12/2010 | Parsheh |
| 2011/0100401 | A1 | 5/2011 | Fiorentini |
| 2011/0107544 | A1 | 5/2011 | Lembo |

FOREIGN PATENT DOCUMENTS

| | | |
|---|---|---|
| WO | 2006010701 | 2/2006 |
| WO | 2010075955 | 7/2010 |
| WO | 2010130373 | 11/2010 |
| WO | 2011026594 | 3/2011 |

OTHER PUBLICATIONS

Bertrand P.E. Danoa, James A. Liburdya, and Koonlaya Kanokjaruvijitb, "Flow Characteristics and Heat Transfer Performances of a Semi-Confined Impinging Array of Jets: Effect of Nozzle Geometry," Department of Mechanical Engineering, Oregon State University, Sep. 2003.

J.A. Marchant and R. Green, "An Electrostatic Charging System for Hydraulic Spray Nozzles," Spray Physics Group, National Institute of Agricultural Engineering, Silsoe, Bedford, UK, Dec. 1981.

34
58
53
56
62
60
35
37
76
43
66
43

34
54
53
84
76
78
86
82
S
29
66
C

FIG. 12
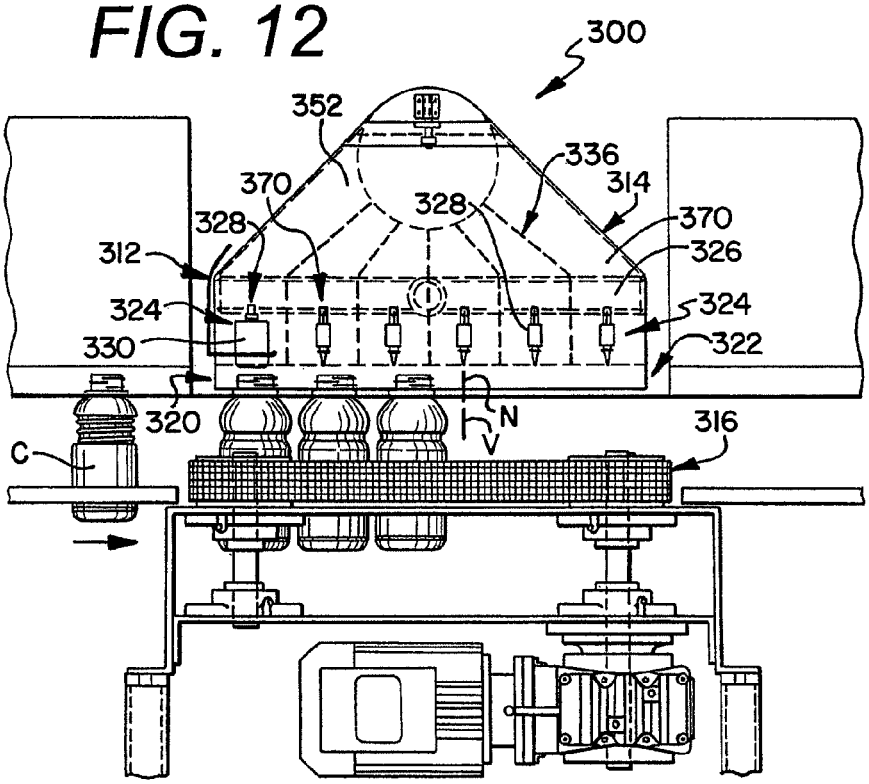
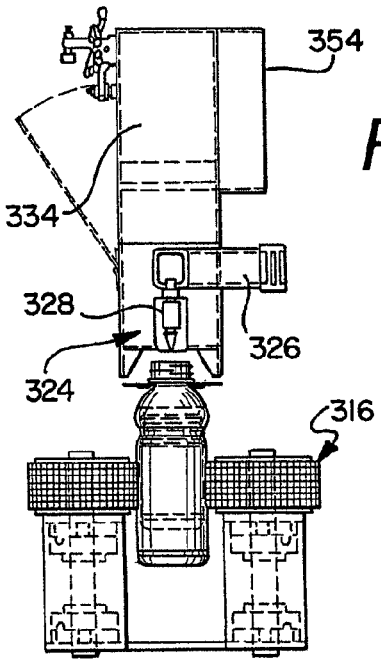
FIG. 13
FIG. 14
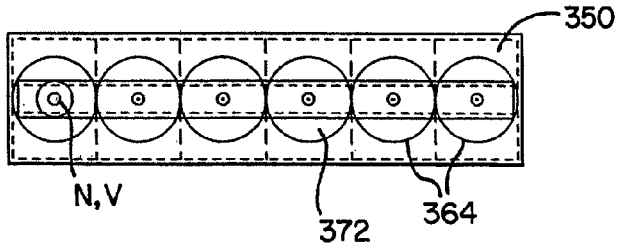

CONTAINER RINSING SYSTEM AND METHOD

RELATED APPLICATIONS

This application is a continuation-in-part of U.S. application Ser. No. 12/255,153, filed Oct. 21, 2008 entitled "Container Rinsing System and Method," now U.S. Pat. No. 8,147,616 issued on Apr. 3, 2012, which claims priority to and the benefit of U.S. Application No. 60/981,571 filed on Oct. 22, 2007 entitled "Container Rinsing System and Method," all of which are incorporated herein by reference and made a part hereof by their entirety.

FIELD OF THE INVENTION

This disclosure relates generally to a container rinsing system and method, and more specifically to air rinsing of containers such as beverage bottles without the use of water or other elements that come into direct contact with the containers.

BACKGROUND

Empty containers, such as PET (polyethylene terephthalate) bottles, are typically used for storing a liquid beverage before the liquid is consumed. Such containers may become contaminated with foreign material, such as paper, wood dust, or plastic debris during shipping, even when they are stored in boxes or other carrying receptacles. The bottles can also become contaminated as they are being processed prior to filling. Moreover, during processing, contact between the containers and the surfaces of articles, such as conveyors or carriers, used to convey the containers, cause the containers to pick up a small amount of net electrostatic charge, thereby rendering the containers capable of attracting fine particles to the containers' internal and external walls. Additionally, the electrostatic charges on the bottles may cause the bottles to cling to one another, thus causing the bottles to move at an angle. This leads to bottles falling off of the conveying system, particularly when using a belt or rope conveying system. Thus, the need to rinse or otherwise clean the containers prior to filling is necessary to ensure that the contents of the beverage within the container are acceptable to the ultimate consumer.

Typical dust particles contaminating these containers are extremely small, often measuring less than 10 microns in diameter. Any electrostatic charges on the containers induce opposite charges on the particles to attract and hold the particles on the container walls. To remove particles adhering to the walls, these opposite charges must be neutralized. Neutralizing the charges is difficult, however, because the charges holding each dust particle to a container wall are shielded by the dust particle itself. Moreover, once the electrostatic forces have been momentarily abated, the freed dust particles must be removed immediately before they re-attach themselves to the container.

Several methods have been implemented to rinse the inside of a container or bottle. The methods include spraying the containers with cold or hot water, utilizing ozone or ozonated water as a sanitizing agent, using ionized gas streams to rinse containers, and using combinations of air and water for rinsing.

Examples of utilizing ionized gas streams systems for rinsing containers are disclosed in U.S. Pat. No. 7,621,301 to Wu et al. and U.S. Publication No. 2009/0101178 to Wu et al., which are fully incorporated by reference. These systems can have many applications in cleaning unwanted particles from containers. For example, these systems can be used in conjunction with a hot fill, ambient fill, cold fill, or aseptic fill applications.

BRIEF SUMMARY

In one embodiment a container rinsing system is provided, such as for beverage containers wherein unwanted foreign particles are evacuated from the containers prior to being filled with a liquid beverage.

In another exemplary embodiment, a container rinsing system has an air nozzle adapted to be positioned proximate an opening of the container and adapted to direct a supply of air to the container. The air can be ionized prior to the air entering into the nozzle. A vacuum member is adapted to be in communication with a vacuum source. The vacuum member is positioned around the air nozzle and is adapted to vacuum foreign particles away from the container.

According to another embodiment, the air nozzle has a nozzle central axis and the vacuum member has a vacuum central axis that is concentric with the nozzle central axis.

According to another embodiment, the air nozzle is positioned to direct the supply of air in any orientation (e.g. downward or upward) depending on the orientation of the container.

According to another embodiment, the system has a plurality of air nozzles and a plurality of vacuum members. Each vacuum member has an air nozzle positioned therein. In another exemplary embodiment, a first air nozzle is an ionizing air nozzle and the remaining air nozzles are high velocity air nozzles. In a further exemplary embodiment, the plurality of nozzles includes a first ionizing air nozzle and the remaining nozzles comprise between 5 and 7 high velocity air nozzles. Alternatively, however, the air can be ionized prior to entering the manifold such that all of the nozzles are ionizing nozzles.

According to another embodiment, the container rinsing system further has a guide positioned adjacent the air nozzle. The guide is adapted to engage a neck of the container for vertical alignment of the container in relation to the air nozzle.

According to another embodiment, the container rinsing system has a conveyor adapted to move the container past the air nozzle and vacuum member. The conveyor has a first moving gripping member and a second moving gripping member, the gripping members are configured to collectively grip the container. In an exemplary embodiment, the first moving gripping member moves at a rate of speed different from the second moving gripping member wherein the conveyor is adapted to rotate the container while moving the container through the rinsing system.

According to another exemplary embodiment, the conveyor may be in the form of an air conveyor. The air conveyor has a track assembly and an air source. Containers are movably supported by the track assembly and the air source moves the containers along the track and past the air nozzles and vacuum members.

In another exemplary embodiment, a method for assembling an air rinsing system for containers is disclosed. The method comprises providing an air source for use in rinsing the containers and connecting a manifold to the air source. The manifold comprises a manifold inlet, an ionization unit, and a manifold outlet. The method further comprises placing the ionization unit within the manifold, such that during operation, air is ionized before exiting the manifold outlet.

In another exemplary embodiment, a method for air rinsing bottles is disclosed. The method comprises providing an air source, receiving air from the air source at a manifold connected to the air source, the manifold comprising a manifold inlet, an ionization unit, and a plurality of manifold outlets, ionizing the air within the manifold with the ionization unit before the air exits the manifold outlets, expelling ionized air from the manifold through the plurality of manifold outlets, and passing a bottle over or under the plurality of manifold outlets, and the ionized air from the plurality of manifold outlets assists in removing particles from the bottle.

It will be appreciated by those skilled in the art, given the benefit of the following description of certain exemplary embodiments of the container rinsing system disclosed herein, that at least certain embodiments disclosed herein have improved or alternative configurations suitable to provide enhanced benefits. These and other aspects, features and advantages of this disclosure or of certain embodiments of the disclosure will be further understood by those skilled in the art from the following description of exemplary embodiments taken in conjunction with the following drawings.

It will be appreciated by those skilled in the art, given the benefit of the following description of certain exemplary embodiments of the container rinsing system disclosed herein, that at least certain embodiments of the invention have improved or alternative configurations suitable to provide enhanced benefits. These and other aspects, features and advantages of the invention or of certain embodiments of the invention will be further understood by those skilled in the art from the following description of exemplary embodiments taken in conjunction with the following drawings.

BRIEF DESCRIPTION OF THE DRAWINGS

To understand the present invention, it will now be described by way of example, with reference to the accompanying drawings in which:

FIG. 12 is a front elevation view of another alternative embodiment of a container rinsing system of the present invention and further partially showing a container handling system;

FIG. 13 is an end elevation view of the container rinsing system shown in FIG. 12 and showing an inlet of the system;

FIG. 14 is a bottom view of the container rinsing system shown in FIG. 13;

DETAILED DESCRIPTION OF CERTAIN EXEMPLARY EMBODIMENTS

Figure 1:
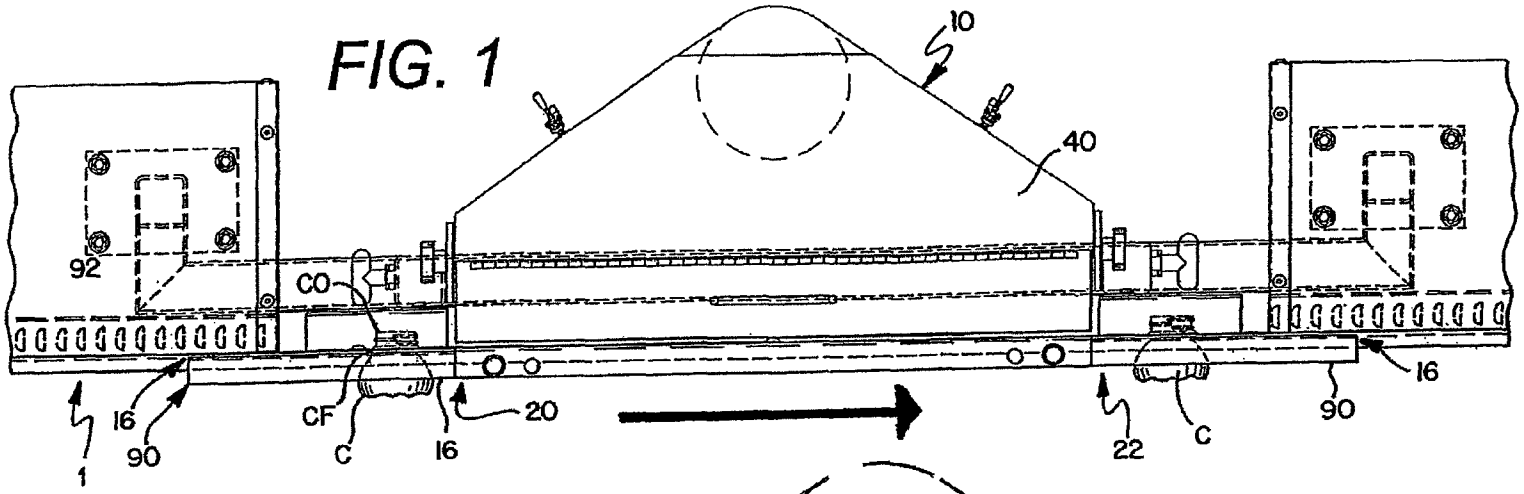
FIG. 1 is a front elevation view of a container rinsing system of the present invention and further partially showing a container handling system.

While this invention is susceptible of embodiments in many different forms, there are shown in the drawings and will herein be described in detail exemplary embodiments of the invention with the understanding that the present disclosure is to be considered as an exemplification of the principles of the invention and is not intended to limit the broad aspect of the invention to the embodiments illustrated.

FIG. 1 shows a container rinsing system generally designated with the reference numeral 10. The container rinsing system 10 generally includes a nozzle assembly 12 and a vacuum assembly 14. In one exemplary embodiment of the invention, the container rinsing system 10 is typically operably associated with a conveyor 16. It is understood, however, that the conveyor 16 is not essential to the container rinsing system 10.

It is understood that the container rinsing system 10 is used in conjunction with a larger container processing assembly line 1 (not completely shown), or container handling system 1. It is understood the container processing assembly line 1 includes various known conveyor assemblies and other handling apparatuses for preparing containers such as beverage bottles, optional additional rinsing of the containers, filling the containers with a beverage or liquid and capping the containers for subsequent shipment for consumption. It is further understood that the assembly line 1 including the container rinsing system 10 transports containers at a high rate of speed, typically in the range of 600-800 bottles per minute.

Figure 2:
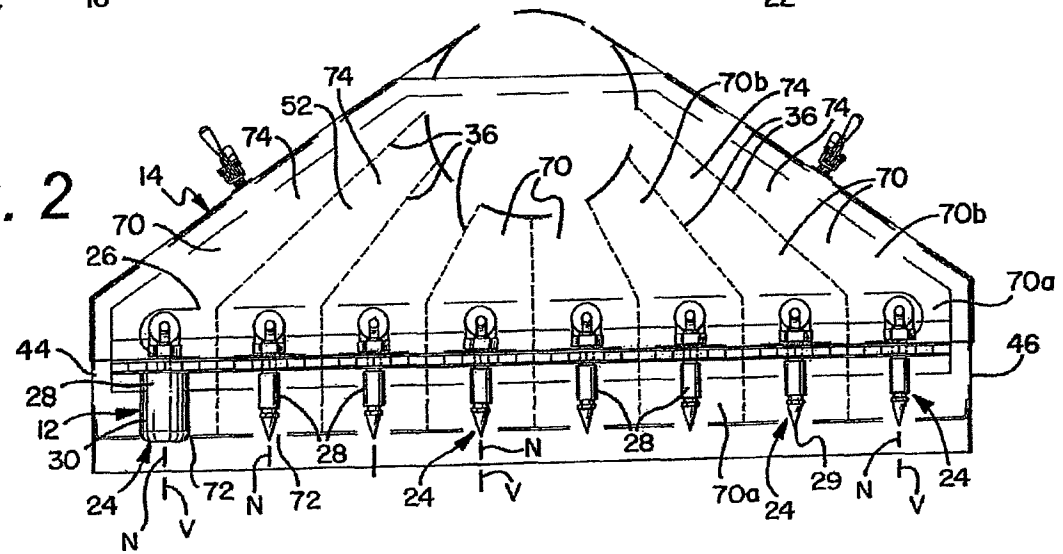
FIG. 2 is a front elevation view of the container rinsing system shown in FIG. 1.
Figure 3:
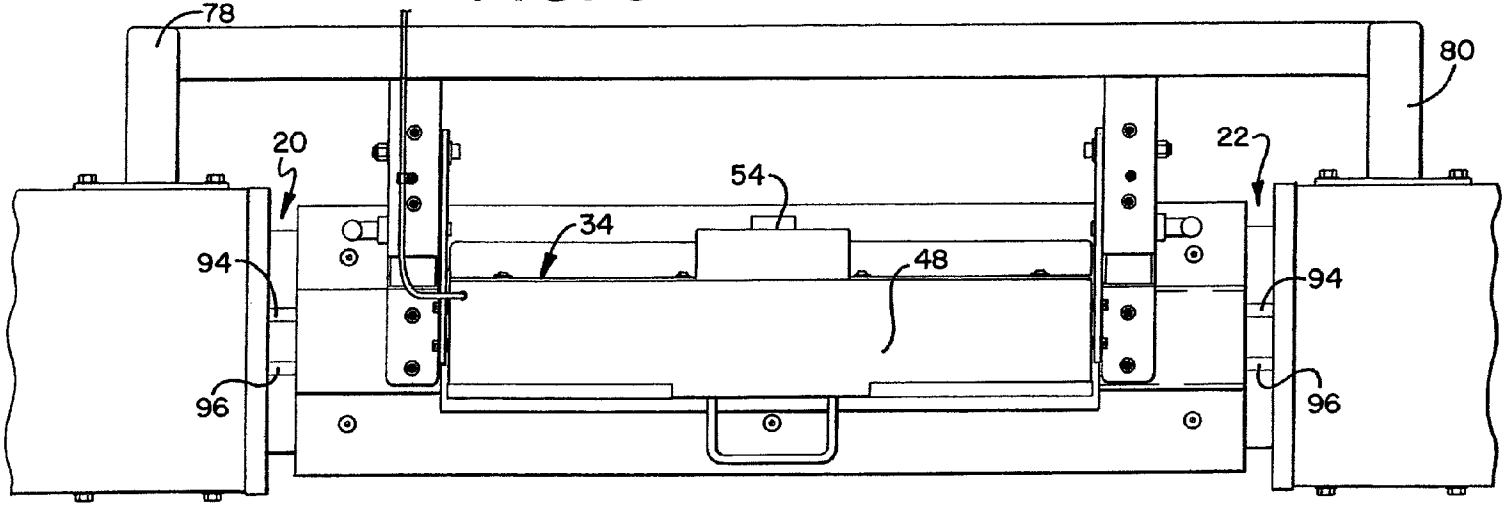
FIG. 3 is a plan view of the container rinsing system shown in FIG. 1.

As shown in FIGS. 1-3, the container rinsing system 10 is positioned along one portion of the container processing assembly line 1. The container rinsing system 10 has a first end 20, or inlet end 20, and a second end 22, or outlet end 22. As will be described in greater detail below, the vacuum assembly 14 may include a housing that defines the inlet end 20 and the outlet end 22. The assembly line 1 delivers a plurality of containers C to the inlet end 20. The conveyor 16 of the container rinsing system 10 then transports the containers C through the rinsing system 10 and past the outlet end 22. The containers C are then transported to other portions of the assembly line 1 for further processing. In one exemplary embodiment of the invention, the containers C are bottles having a bottle finish CF and having a container opening CO to be filled with a liquid beverage. The bottle finish CF may also have a neck ring extending around a circumference of the container C.

As will be explained in greater detail below, the nozzle assembly 12 has a plurality of nozzles and the vacuum assembly 14 has a plurality of vacuum members. In one simple form, a respective nozzle is operably associated with a respective vacuum member to form a rinsing module 24. In particular, the nozzle 12 is positioned within the vacuum member 14 wherein the vacuum member 14 generally surrounds the nozzle 12. The rinsing system 10 utilizes a plurality of rinsing modules 24 arranged in series in one exemplary embodiment of the invention.

Figure 4:
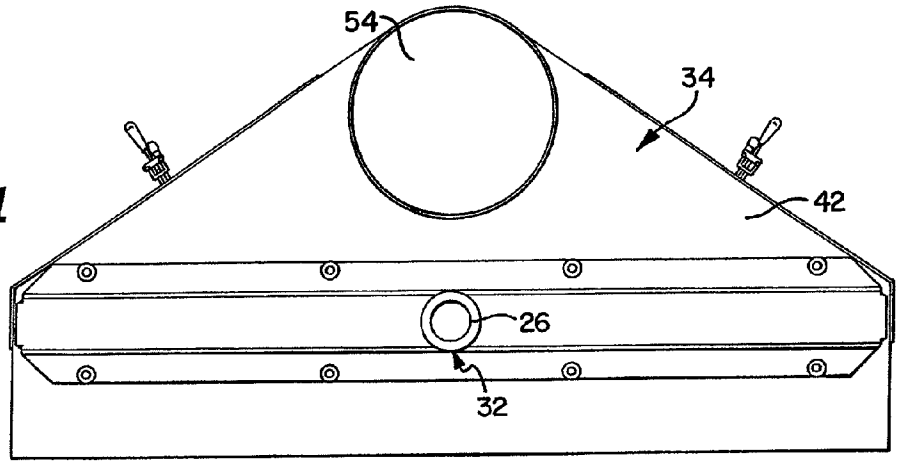
FIG. 4 is a rear elevation view of the container rinsing system shown in FIG. 1.
Figure 7:
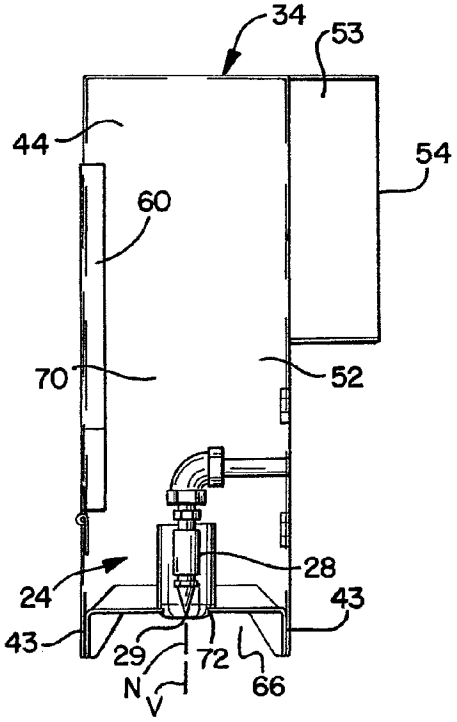
FIG. 7 is an end view of the container rinsing system shown in FIG. 1 and showing an outlet of the system.
Figure 8:
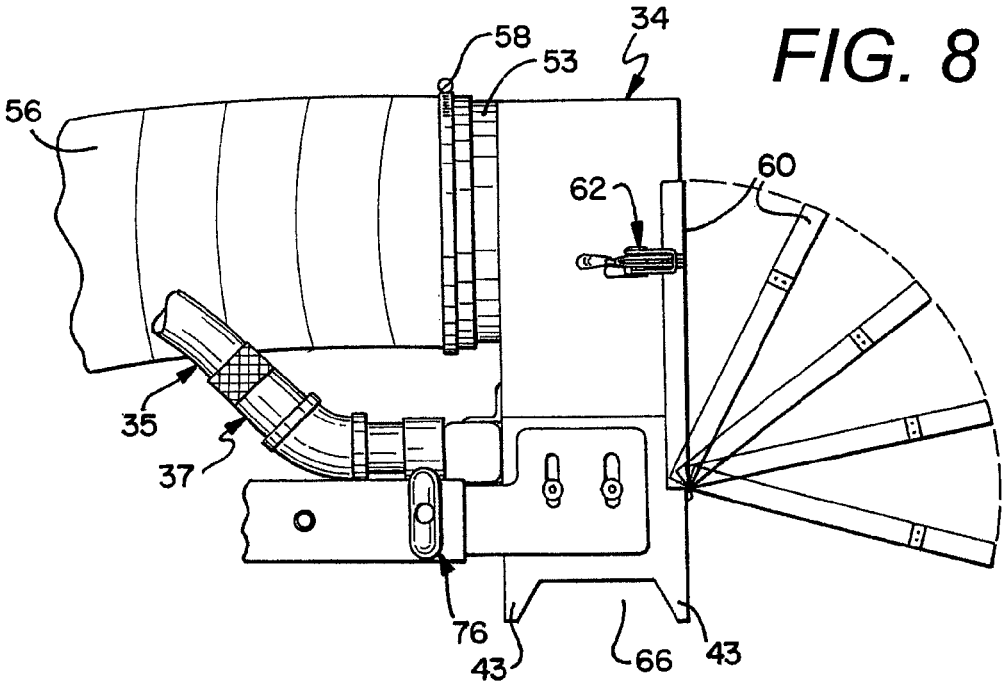
FIG. 8 is an end view of the container rinsing system shown in FIG. 6 and showing additional components of the system.

FIGS. 2 and 7 further show the nozzle assembly 12. The nozzle assembly 12 generally includes a nozzle manifold 26 and a plurality of individual nozzles 28 in fluid communication with the manifold 26. One of the individual nozzles 28 is an ionizing nozzle 30 having suitable electrical connections. As shown in FIGS. 4 and 8, the nozzle manifold 26 has a central inlet opening 32 that receives an air supply hose 35 via a quick disconnect-type fitting 37 (FIG. 8). In one exemplary embodiment of the invention, the plurality of nozzles are eight nozzles 24 including the one ionizing nozzle 30 and seven high speed air jet nozzles 28. Alternatively, the air can be ionized within the nozzle manifold such that each of the plurality of nozzles expel ionized air. The nozzles 28 are spaced along the nozzle manifold 26 from proximate the inlet 20 of the system 10 and the outlet 22 of the system 10. The nozzles 28 are spaced generally equidistant along the rinsing system 10. The nozzles 28, 30 are positioned such that distal ends 29 of the nozzles 28 are directed in a downward direction. However, the nozzles 28, 30 can be oriented in any direction. As explained in greater detail below, the nozzle assembly 12 is operably associated with the vacuum assembly 14. Thus, the nozzle manifold 26 is contained within the vacuum assembly 14 and the central inlet opening 32 is positioned in a corresponding opening in a rear portion of the vacuum assembly 14. As discussed in greater detail below, the nozzles 28 generally have a nozzle central axis N.

FIGS. 1-9 further show the vacuum assembly 14. The vacuum assembly 14 generally includes a housing 34 having a plurality of inner walls 36 defining a plurality of vacuum members 70.

The housing 34 has a front wall 40, a rear wall 42, a first end wall 44, a second end wall 46, a top wall 48 and a bottom wall 50. The walls 40-50 are connected together to form an inner cavity 52. As shown in FIGS. 4 and 8, the rear wall 42 has an outlet opening 54. The outlet opening 54 is in communication with the inner cavity 52. The outlet opening 54 is located proximate a top of the rear wall 42 and the housing 34 generally tapers towards the outlet opening 54. The housing 34 may have an extension member 53 defining the outlet opening 54. The outlet opening 54 is connected to a vacuum hose 56 (FIG. 8) via a quick release clamp 58 to be described in greater detail below. The rear wall 42 further has an aperture to accommodate the nozzle manifold 26. The front wall 40 has a front access door 60 hingedly connected to the housing 34 providing selective access to the vacuum assembly 14 via a door latch 62.

Figure 5:
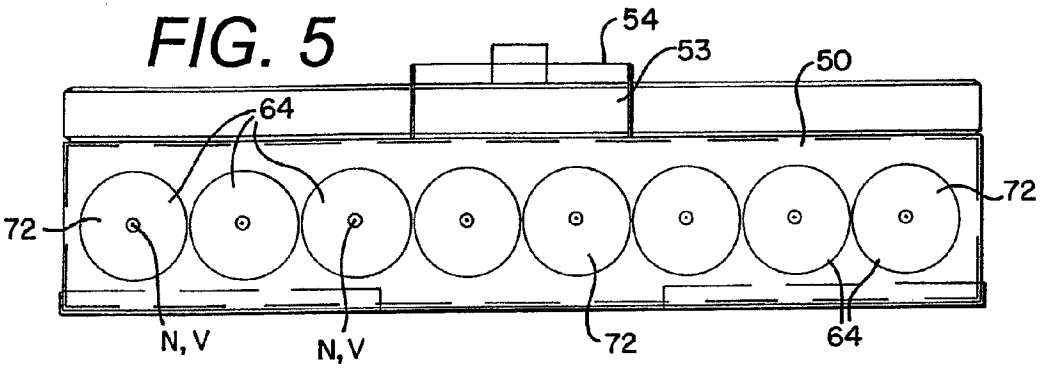
FIG. 5 is a bottom view of the container rinsing system shown in FIG. 1.
Figure 6:
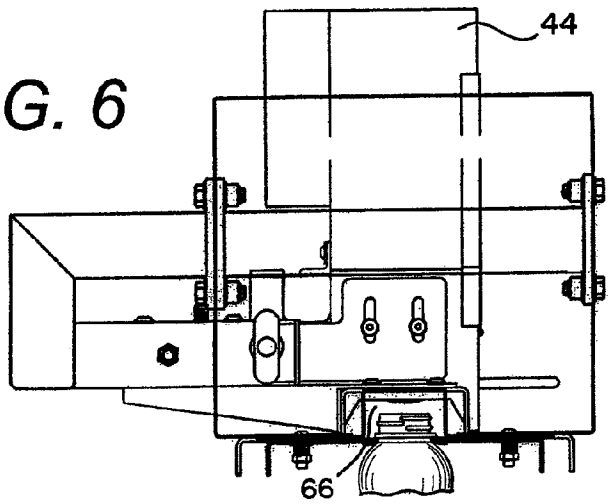
FIG. 6 is an end view of the container rinsing system shown in FIG. 1 and showing an inlet of the system.

As shown in FIGS. 5-7, the bottom wall 50 has a plurality of bottom openings 64 therein. In one exemplary embodiment, the bottom openings 64 are circular although other shapes are possible such as square or rectangular. The bottom wall 50 is spaced upwards from distal ends of the front wall 40 and rear wall 42. The distal ends of the front wall 40 and the rear wall 42 form depending legs 43 that define a channel 66 extending from the rinsing system inlet 20 to the rinsing system outlet 22. As shown in FIG. 2, the inner walls 36 are positioned in the inner cavity 52 of the housing 34. The inner walls 36 define a plurality of vacuum members 70. The vacuum members 70 may have various cross-sectional configurations including circular, square or rectangular. Each bottom opening 64 defines a vacuum member inlet 72. Each vacuum member 70 is a duct that defines a passageway 74 extending from the bottom opening 64, or vacuum member inlet 72 to the outlet opening 54. The vacuum members 70 are separate from one another. In addition, the vacuum members 70 have a first segment 70*a* that has a general vertical orientation and a second segment 70*b* that has an angled orientation extending and converging to the outlet opening 54. As further shown in FIG. 2, the vacuum members 70 extend to the outlet opening via each respective second segment 70*b* wherein the vacuum members 70 share a common outlet in the form of the outlet opening 54. It is understood that the vacuum members 70 could have separate outlet openings as well as segments having only a vertical orientation. As discussed in greater detail below, the vacuum members 70 generally have a vacuum member central axis V.

As shown in FIGS. 1, 3, 8 and 9, a support structure 76 is associated with the housing 34. The support structure has a first arm 78 connected at one end of the housing 34 and a second arm 80 connected at an opposite end of the housing 34. The arms 78, 80 are connected to the housing 34 via adjustment bolts 82 that cooperate in slots 84 positioned in the arms 78, 80. This connection configuration allows for adjustment of the rinsing system height as described in greater detail below. The support arms 78, 80 also have hinge release knobs 86 for further manipulation of the housing 34 of the rinsing system 10.

As discussed, the nozzle assembly 12 is operably associated with the vacuum assembly 14. As further shown in FIGS. 2 and 5-7, the nozzle manifold 26 is positioned within the housing inner cavity 52. The inlet 32 of the nozzle manifold 26 is positioned in the aperture of the rear wall 42. Each nozzle 28 is in communication with and extends from the nozzle manifold 26. Each nozzle 28 extends in a respective vacuum member 70 and in a generally vertical orientation wherein the nozzle 28 is directed in a downward direction. The vacuum member 70 is thus positioned around the nozzle 28. Furthermore, it is understood that the vacuum member 70 defines an outer periphery wherein the nozzle 28 is positioned within the outer periphery of the vacuum member 70. The nozzle 28 extends in the first segment 70*a* of the vacuum member 70. A distal end 29 of each nozzle 28 is positioned proximate the bottom openings 64 at the respective inlets 72 of each vacuum member 70. In addition, in an exemplary embodiment, the nozzle 28 is positioned generally at a center of the vacuum inlets 72. Thus, the nozzle central axis N is generally coincident or concentric with the vacuum member central axis V. In this configuration, the nozzle 28 is considered to be generally concentric or coincident with the vacuum member 70. The nozzle 28 and vacuum member 70 are considered to have a common central axis in an exemplary embodiment. Other configurations are possible wherein the central axes may be offset while the vacuum member 70 still surrounds or is placed around the nozzle 28. In embodiments where the bottom opening 64 may have other shapes such as square or rectangular, the nozzle 28 is positioned to be generally centered in such a bottom opening. This may also be considered a concentric-type configuration. These structures may be considered to share a common center.

It is understood that the inner walls 36 have appropriate access openings to accommodate the nozzle manifold 26 and nozzles 28 which are sealed to maintain separation between the vacuum members 70. As further shown in FIG. 2, the ionizing nozzle 30 is positioned at the first vacuum member 70 proximate the inlet 20 of the rinsing system 10. A respective nozzle 28 is positioned as described above in a respective vacuum member 70 in concentric fashion. The distal end 29 of the nozzle 28 is positioned proximate the vacuum inlet 72 and does not extend past the bottom wall 50, such that the distal end 29 of the nozzle 28 is positioned at substantially the same height as the vacuum inlet 72. The distal end 29 can extend or protrude slightly past or be positioned above the bottom wall 50 in other embodiments. The nozzle manifold 26 can be adjusted relative to the housing 34 to achieve such configurations. The nozzles 28 could also be provided with structure for individual adjustment.

Each respective nozzle 28 and vacuum member 70 is considered to define the rinsing module 24. In one exemplary embodiment, the rinsing system 10 has eight rinsing modules 24 wherein eight nozzles 28 are positioned in eight vacuum members 70. While in an exemplary embodiment, the nozzles 28 and vacuum members 70 lead to a common communication conduit (nozzle manifold 26, vacuum outlet 54), it is understood that each nozzle 28 and vacuum member 70 can be separate from one another and be connected to a separate air and vacuum source.

As further shown in FIG. 8, the vacuum hose 56 is connected to the outlet opening 54 at the housing 34 wherein the vacuum hose 56 is in fluid communication with all of the vacuum members 70. The vacuum hose 56 is connected to a suitable vacuum source. The nozzle inlet 32 is connected to the air supply hose 35 with the quick-disconnect fitting 37 wherein the air supply hose 35 is connected to a suitable pressurized, compressed air source. It is understood that such compressed air is suitably filtered.

As discussed, the conveyor 16 is operably associated with the rinsing system 10 as well as other components of the overall container handling system 1. In the exemplary embodiment shown in FIGS. 1-9, the conveyor 16 (FIG. 1) has a track assembly 90 and pressurized air ducts 92. The track assembly 90 includes a first track member 94 spaced from a second track member 96 (FIG. 3). The track members 94, 96 receive and support the container finish CF wherein the neck ring on the container C rides along the track members 94, 96. The spacing between the track members 94, 96 is adjustable to accommodate different sized containers C. A pressurized air source is provided wherein pressurized air is directed at the containers C through the ducts 92. Thus, as shown in FIG. 1, the container C is moved along the track members 94, 96 in the direction of the arrow by the pressurized air directed onto the containers C.

Figure 9:
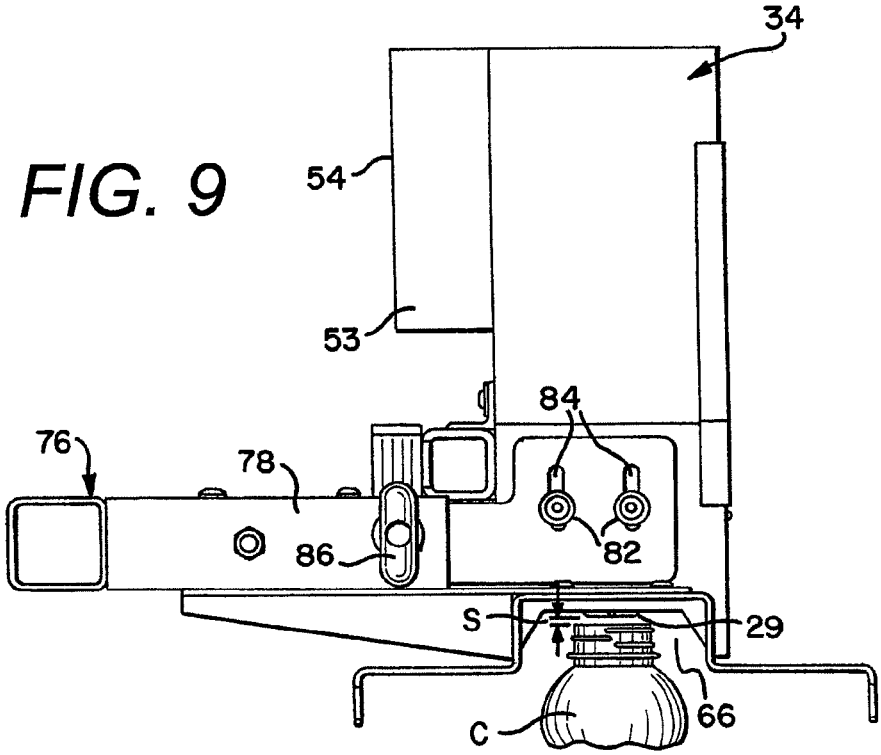
FIG. 9 is an end view of the container rinsing system shown in FIG. 6 and showing a container adjacent to an air nozzle and vacuum member.

As shown in FIG. 1, the container rinsing system 10 is operably connected with other components of the overall container handling system 1. The container rinsing system 10 is positioned along the handling system 1 such as shown in FIG. 1. The height of the housing 34 is set accordingly such that the containers C will pass through the rinsing system 10 at a desired predetermined spacing S (FIG. 9). In one exemplary embodiment, the spacing S may be ⅛ in. This spacing S can vary. It is desirable to have as minimal spacing S as possible such that the rinsing module 24 is as close to the container opening CO as possible while allowing clearance for the containers C to pass through the rinsing system 10. The conveyor 16 is operably connected with other conveyor members in order to receive containers C from the handling system 1 and to deliver the rinsed containers C exiting the rinsing system 10 for further processing by the container handling system 1. It is understood the pressurized air source for the conveyor 16 is energized. The vacuum hose 56 is connected to the vacuum assembly outlet 54 and the vacuum source is energized. In addition, the air supply hose 35 is connected to the nozzle manifold 26 and the pressure air source for the nozzle assembly 12 is energized. It is also understood that the housing 34 and conveyor 16 can be mounted having a minimal slope to assist in the movement of the containers C along the tracks 94, 96.

In any of the above embodiments, the unit can be provided with automatic shut-off switches. The switches can be arranged with sensors for detecting whether air is being supplied to the system from the nozzles or whether the vacuum members are providing suction.

Operation of the container rinsing system will now be described. With the handling system 1 and conveyor 16 energized, a container C is conveyed to the inlet 20 of the rinsing system 10 wherein the neck ring on the container finish CF rides along the track members 94, 96. The track members 94, 96 serve as a guide to engage the neck of the container C for vertical alignment of the container C in relation to the nozzle 28 and vacuum member 70. The container C is conveyed in an upright fashion wherein the container opening CO faces upwards. It is understood that a plurality of adjacent containers C are conveyed one after another by the conveyor 16. The container C passes through the channel 66 (FIG. 9) defined by the housing 34. As the container C reaches the first rinsing module 24, pressurized ionized air from the first ionizing nozzle 30 is injected into the container C through the container opening CO. The nozzle 30 directs the compressed air in a downwards direction. This pressurized air dislodges foreign particles, contaminants etc. from the surfaces of the container C. The ionized air also neutralizes the inside and outside surfaces of the container C preventing particles from unduly adhering themselves to the surfaces. At the same time, the vacuum member 70 provides suction to the container C wherein any such particles or contaminants are directed away from the container C. The vacuum members 70 provide suction in an upward direction or any direction depending on their orientation. The container C continues to be conveyed along the conveyor 16 and through the rinsing system 10 wherein the container C passes through each successive rinsing module 24 positioned in series. Accordingly, the container C is subjected to pressurized air from each nozzle 28 and suction from each vacuum member 70 from the remaining seven nozzle/vacuum members of the rinsing modules 24 of the rinsing system 10. The configuration of the rinsing modules 24 provide an operational zone around each nozzle 28 to immediately pick up foreign particles and contaminants and direct such particles through the vacuum members 70 and through the vacuum hose 56. Accordingly, the container C is suitably rinsed wherein foreign particles or contaminants are dislodged from the surfaces of the containers C by the nozzles 28 and the vacuum members 70 simultaneously remove the foreign particles or contaminants from the containers C before any foreign particles re-adhere to the containers C. The containers C continue along the conveyor 10 and to other portions of the container handling system 1 to be filled, capped and prepared for shipment.

It is understood that the containers C move at considerable speeds through the system 10. The system 10 is capable of rinsing containers at 600-800 containers per minute wherein the container C is at each rinsing module 24 for fractions of a second. The pressurized filtered air can be provided at various pressures and in one exemplary embodiment, the pressurized air is at 40-70 psi. As discussed the predetermined spacing S can be varied as desired and can be ⅛ in. in one embodiment. By loosening the adjustment bolts 82, the housing 34 can be vertically adjusted via the slots 84 to vary the spacing S. The knobs 86 can also be used to tilt the housing 34 when cleaning or servicing the system 10. The access door 60 also provides easy access into the housing 34 to adjust the nozzle assembly 12, perform maintenance or clean the nozzle assembly 12 or vacuum assembly 14. The vacuum hose 56 and air supply hose 35 are also easily removable. Generally, the rinsing system 10 can be easily and rapidly adjusted as desired. In other variations, rinsing modules 24 can be set up to travel with the containers C for rinsing.

Figure 11:
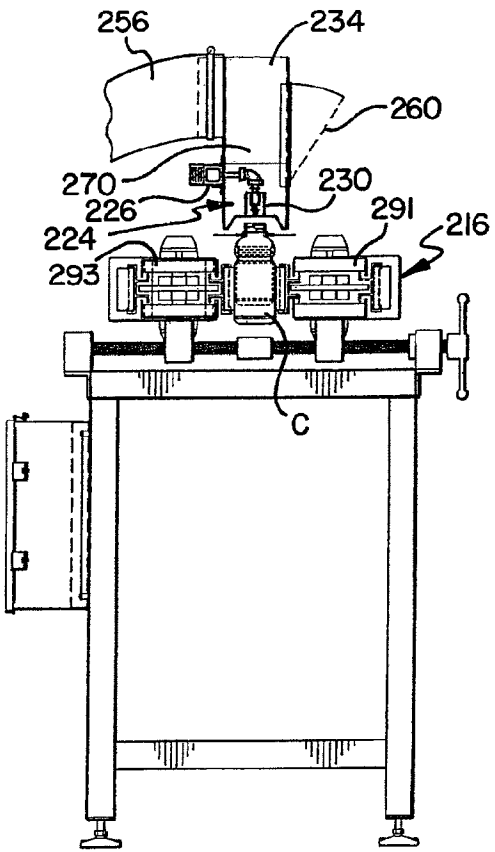
FIG. 11 is an end view of the container rinsing system shown in FIG. 10, and showing an inlet of the system.
Figure 10:
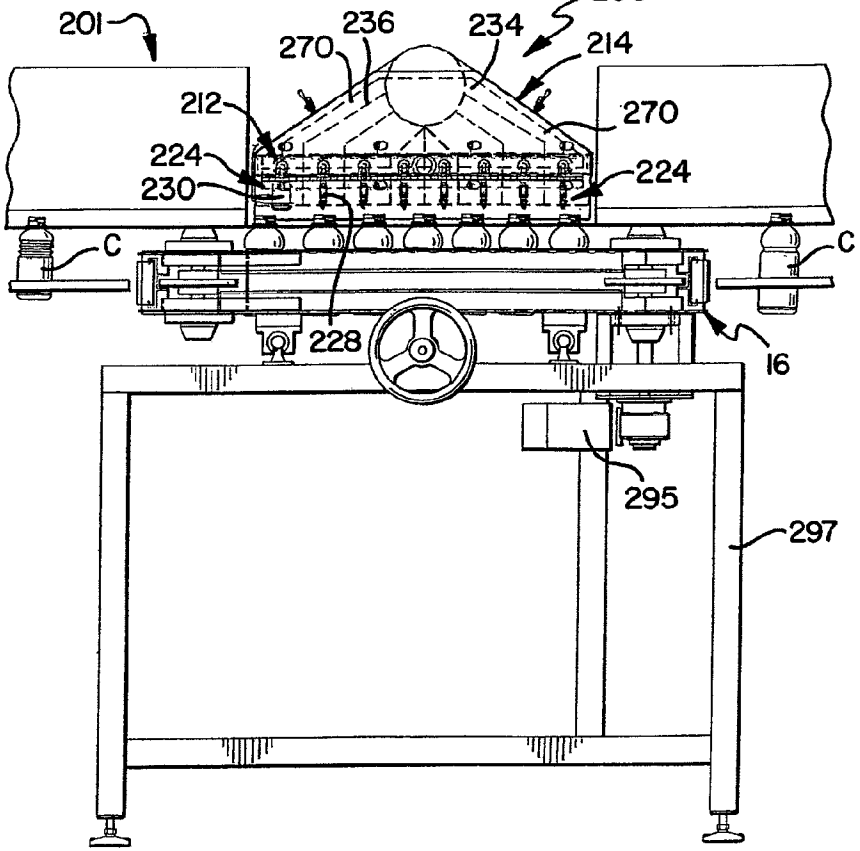
FIG. 10 is a front elevation view of an alternative embodiment of a container rinsing system of the present invention and further partially showing a container handling system.

FIGS. 10-11 disclose an alternative embodiment of a container rinsing system of the present invention, generally designated with the reference numeral 200. Many components are similar to the rinsing system shown in FIGS. 1-9 and will be designated with similar reference numerals in the 200 series of reference numerals.

In this embodiment the container rinsing system 10 is generally the same as the container rinsing system 10 shown in FIGS. 1-9. The system 200 utilizes eight rinsing modules 224 constructed as described above. A belt-driven conveyor 216 is provided in this embodiment to convey the containers C through the rinsing system 200.

The conveyor 216 generally includes a first gripper member 291, a second gripper member 293 and a motor 295. These components are generally supported by a frame 297 that may rest on a floor or other support surface. Each gripper member 291, 293 have a rotatable belt and other supporting structure as is known. The first gripper member 291 is spaced from the second gripper member 293 a predetermined distance to accommodate the containers C. As shown in FIG. 11, this spacing is adjustable to accommodate containers having various diameters. The motor 295 is operably connected to the first gripper member 291 and the second gripper member 293 as shown in FIG. 10. It is understood that the rinsing system 200 is supported by suitable support members above the conveyor 216 as is desired for the containers C to pass through the rinsing system 200 at the desired spacing.

In operation, the first and second gripper members 291, 293 are rotated by the motor. Containers C are received from the container handling system 1 wherein the gripper members 291, 293 grip the containers C and convey the containers C through the rinsing system 200. The rinsing system 200 rinses the containers C as described above. The gripper members 291, 293 convey the containers C to other portions of the container handling system 1 for further processing. It is understood that the operable connections between the motor 295 and first gripper member 291 and second gripper member 293 can be such that one gripper member rotates at a greater speed relative to the other gripper member. In this fashion, the container C is also rotated about its center point as the container C moves linearly through the rinsing system 200. This can assist in the rinsing process.

FIGS. 12-14 disclose another alternative embodiment of a container rinsing system of the present invention, generally designated with the reference numeral 300. Certain components are similar to the rinsing system shown in FIGS. 1-9 and FIGS. 10-11 and will be designated with similar reference numerals in the 300 series.

In this embodiment, the conveyor 316 is generally the same in the embodiment of FIGS. 10-11. The rinsing system 300 is also similar to the rinsing system of FIGS. 1-9, but uses six rinsing modules 324. As such, the housing 334 has inner walls 336 that separate the inner cavity 352 into six vacuum members 370. The nozzle manifold 326 supplies pressurized air to the six air nozzles 328. The first air nozzle 330 is an ionized air nozzle and the remaining five nozzles are high speed air jet nozzles. Each nozzle 330 is positioned in concentric fashion within the vacuum member 370 consistent with the above description.

In operation, containers C are conveyed through the rinsing system 300 by the conveyor 316 operating in similar fashion to the conveyor of FIGS. 11-12. The rinsing system 300 also operates in similar fashion wherein the nozzle assembly 312 supplies air in a downward direction while the vacuum assembly 314 supplies suction in an upward direction depending on the orientation of the bottles. The containers C pass by each rinsing module 324 and are then directed to additional portions of the container handling system 1 for further processing.

Figure 15:
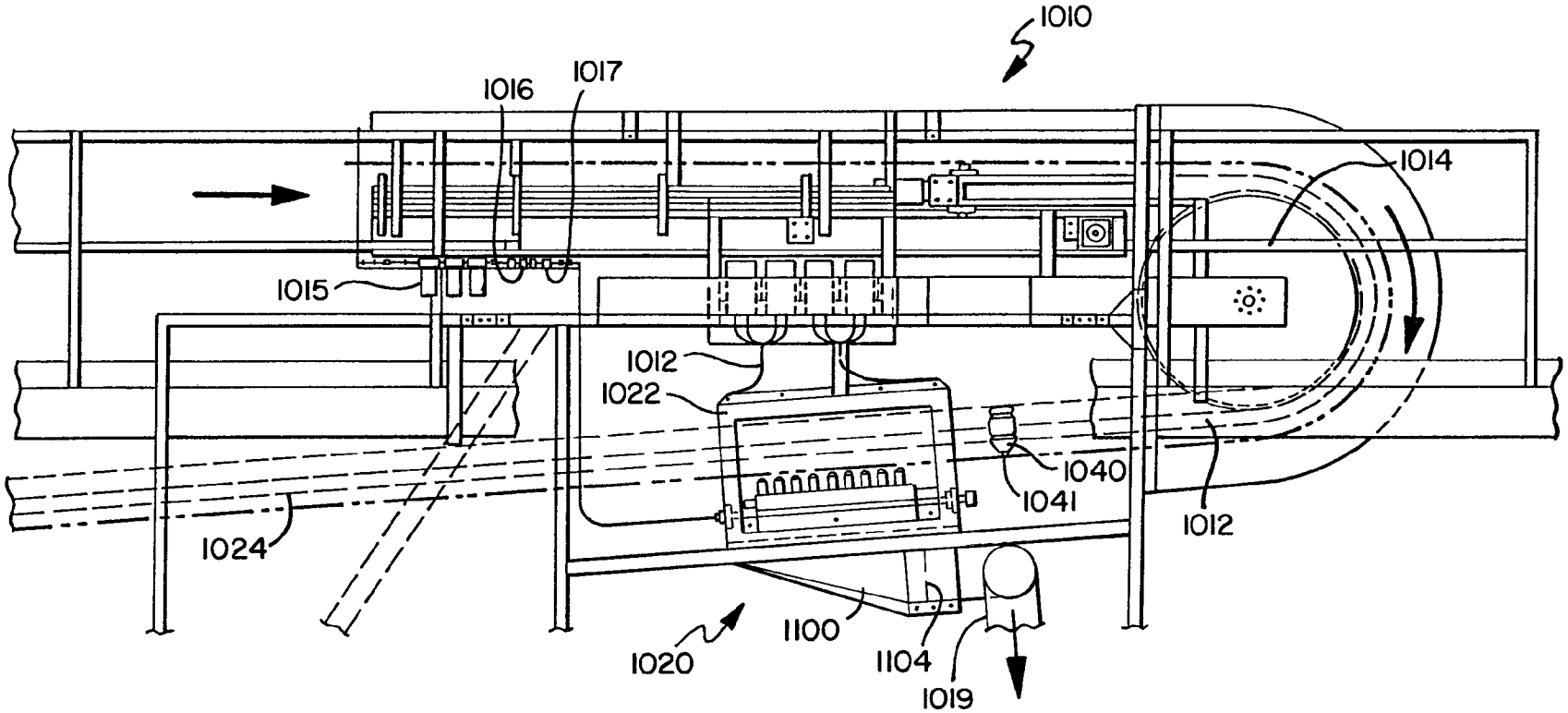
FIG. 15 shows a perspective view of another exemplary embodiment of a container rinsing system.

FIG. 15 shows another arrangement of an exemplary container rinsing system 1010. The container rinsing system 1010 is generally provided with an air source (not shown), such as any mechanical device that supplies pressurized air, a cleaning system 1020 for air rinsing the bottles, an electrical control panel (not shown) for running the rinsing operation, and a vacuuming system 1100 for removal of unwanted particles and for air circulation.

The cleaning system 1020 is provided for cleaning the inside of the bottles 1040 as they are transported through the system 1010. The container rinsing system 1010 can include a series of guards 1024, shown in phantom in FIG. 15, which retain the bottles 1040 in a conveyor arrangement 1012 to permit the bottles 1040 to pass through each station at a very high rate of speed, on the order of 800 bottles per minute.

A conveyor arrangement 1012 and a large pulley wheel 1014 are provided for transferring the bottles 1040 through the cleaning system 1020. The bottle flow path follows the direction of the arrows depicted in FIG. 15. As the bottles 1040 pass through the rinsing system 1010, the bottles 1040 become inverted in a generally upside down position with the bottle opening being downwardly directed, as shown in FIG. 15. However, the bottles 1040 and the rinsing system 1010 can be orientated in any desired manner. The bottles 1040 can be held in the conveyer arrangement 1012 by finger grippers 1039. Such finger grippers 1039 are available, for example, from Ambec, Inc. of Lynchburg, Va. Other methods of conveying the containers are contemplated. For example, neck grippers, conveyors, ropes either alone or in combination with guide rails or guards can be used. An air duct 1019 is provided, leading to the blower (not shown) for withdrawing air from the air cleaning system 1020, through a series of ducts.

Figure 16A:
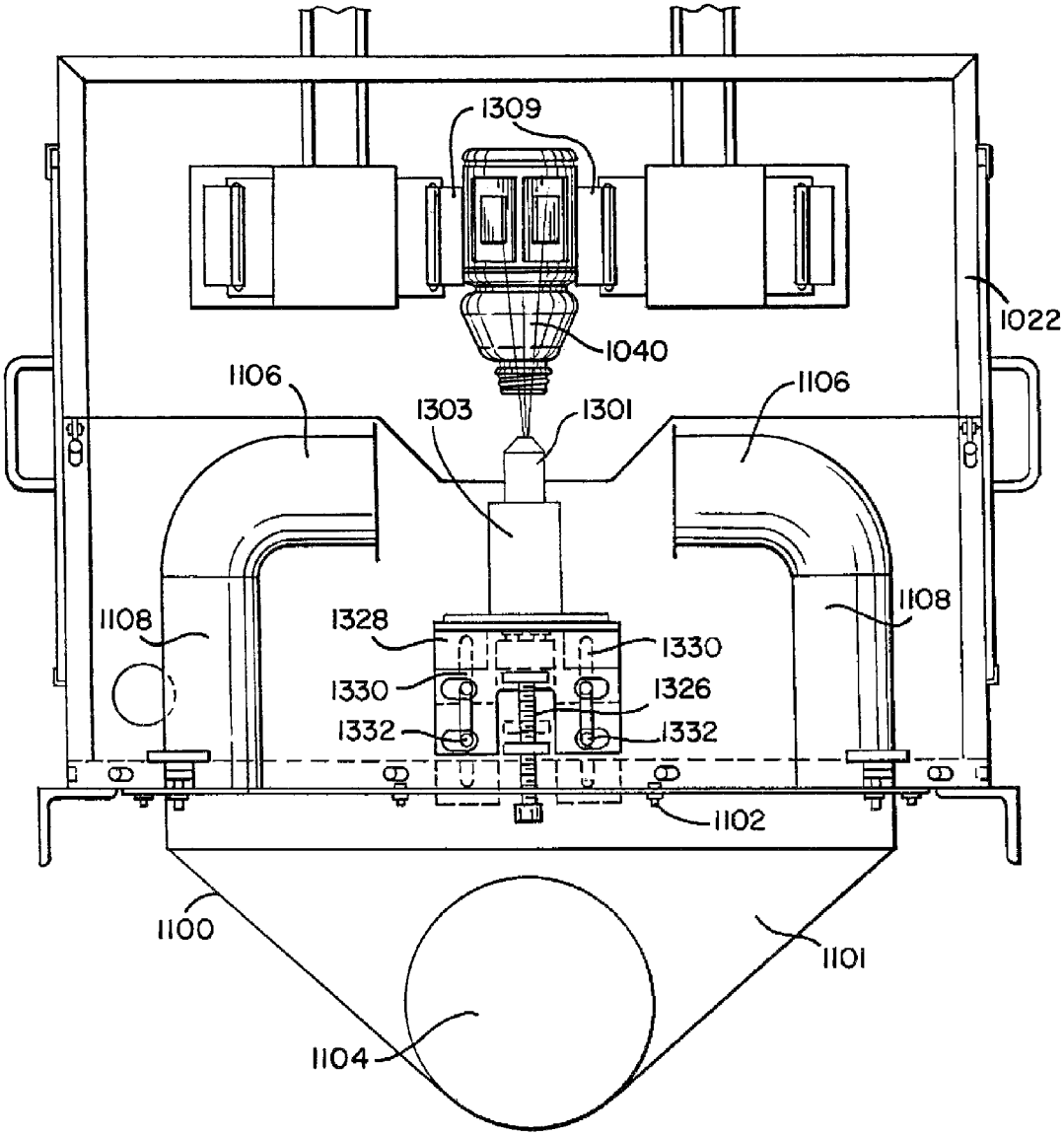
FIG. 16A shows partial front view of the exemplary embodiment of FIG. 15.
Figure 16B:
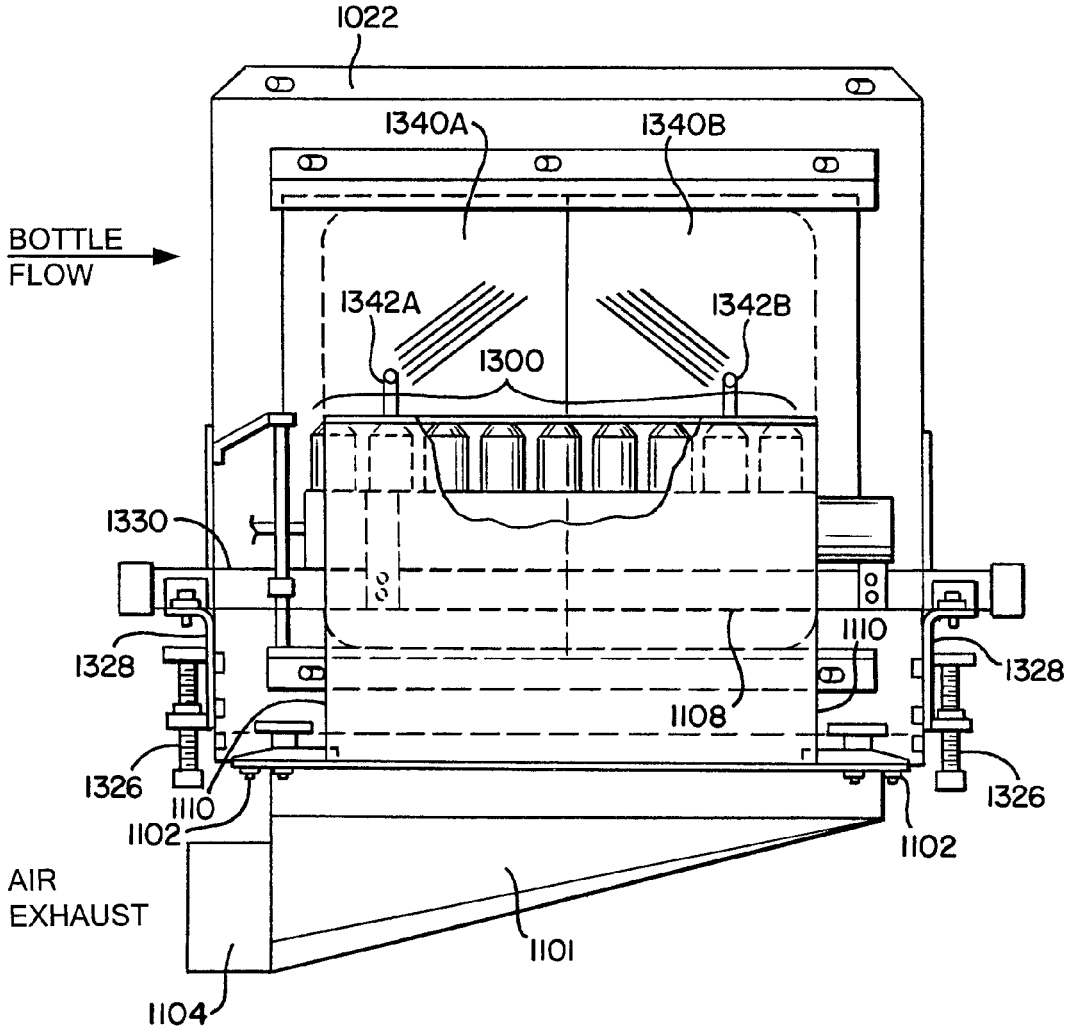
FIG. 16B shows partial side view of the exemplary embodiment of FIG. 15.

The air cleaning system 1020 is essentially enclosed by housing 1022 providing an enclosure to maintain substantial equilibrium of air flow within the system 1020. Two openings, one of which is shown in FIG. 16A, are disposed at either longitudinal end of the enclosure 1022, which are required to permit the passage of the bottles 1040. As shown in FIG. 16B, the enclosure 1022 can be provided with two plexiglass doors 1340A and 1340B. The plexiglass doors 1340A and 1340B can be provided with handles 1342A and 1342B for easy access to the inside area of the enclosure 1022 for maintaining the system.

The rinsing system 1010 can be provided with an air source to provide air to the containers 1040. HEPA filters can be placed at the air source inlet and outlet for filtering any unwanted particles from the air. A 0.3μ (99.9% efficiency) HEPA filter or pre-filtering assembly can be added to the air source inlet to screen off microorganisms from the supply air and a 0.5μ (99% efficiency) HEPA filter can be added to the outlet of the air source as a preventative measure for any unforeseeable debris from the air source. The embodiments disclosed herein could be implemented with any air source known in the art.

The nozzles 1301 can be provided with internal ionization units within a nozzle manifold 1303, which can be configured to ionize the air before the air exits the nozzles. The nozzle array 1300 can be mounted on the nozzle manifold 1303. As shown in FIGS. 16A and 16B, the nozzle array height can be adjusted up and down by height adjustment screws 1326. The air nozzle array is mounted to an adjustable bracket 1328, which has slots 1330 and guide pins 1332 for adjusting the height of the nozzle array 1300 with respect to the bottles 1040 and grippers 1039.

Air from the air source is exposed to the air ionizing units, which ionize the air for assisting with removing particles from the passing containers. After the air is ionized it is directed into the nozzles. As can be observed from this arrangement, the air is ionized before reaching and exiting the nozzles. This enhances cleaning, creates a reliable and durable source for ionized air, and creates a system that is easy to maintain.

Referring again to FIGS. 15, 16A, and 16B, the rinsing system 1010 can also be equipped with a vacuum system 1100 for vacuuming unwanted particles from the bottles 1040 as they move on the conveyor 1012. The vacuum system 1100 comprises a vacuum pan 1101, which extends underneath the bottle flow path and underneath the air manifold 1300. The vacuum pan 1101 is essentially in the form of a trough that becomes shallower in the direction of the bottle flow path, as shown in FIG. 16B. Along a centrally located longitudinal portion, the trough is folded, and at the point adjacent and directly beneath the ionizing nozzles 1301, is connected, for example, by screws 1102 to a vacuum duct 1104, which in one embodiment is in the form of a cylinder as shown in FIG. 16A. The vacuum system 1100 can be provided with two elbow shaped-manifolds or vacuum manifolds 1108, which each have suction inlets 1106. The vacuum manifolds 1108 are located on either side of the manifold 1303 for vacuuming unwanted particles from the system. As shown in FIG. 16B, the vacuum manifolds 1108 can be provided with diverging portions 1110 for expanding the vacuumed area inside of the housing 1022.

The vacuum duct 1104 is connected to the duct 1019, (shown in FIG. 1) which is in fluid communication with a vacuum source or air source (not shown) that provides a suction or vacuum force to the environment within the housing 1022, where the nozzle array 1300 is contained. The vacuum system 1100, which is powered by the vacuum source, continually evacuates the air within the housing 1022, together with any floating ionized dust or other particles that have been removed from the surfaces of the bottles 1040 through the suction inlets 1106. In addition, to helping extract the floating ionized dust or other particles that have been removed from the surfaces of the bottles 1040, the vacuum system 1100 also helps in removing dirty air from the rinsing system 1010.

In one embodiment, the vacuum system 1100 can form part of a closed loop system in that the air extracted by the vacuum can be filtered by a HEPA filter and recycled back to the air source and then provided to the nozzle array 1300 for use in rinsing the bottles 1040 in the cleaning process. In another exemplary embodiment a separate vacuum source can be used, such as a Dayton model 2C940 blower. In either instance, the inlet of the source is attached to the vacuum duct 1019.

An electrical control panel interacts with plant PLC, which enables the air source to run at an optimal fan rate depending on the particular bottle size and conveyor speed. Additionally, the electrical control panel (not shown) is electrically connected to the nozzles disposed on the nozzle array 1300 within the bottle cleaning station 1020 to provide operator control.

The rinsing system 1010 is also equipped with sensors at key locations for ensuring cleaning performance. Upon detection of an error in the system, for example, low air pressure, improper filtration, or a non-functioning ionizer, the system can be configured to give a warning signal to the operator and can be configured to shut down operation. In any of the above embodiments, if any of the sensors connected to the vacuum members or the nozzles senses a lack of suction or a lack of air pressure respectively, the system is automatically shut down via an automatic shut-off switch.

During operation, the cleaning system 1020 cleans the inside of the bottles 1040 as they are transported through the rinsing system 1010. The bottles 1040 are transported through the rinsing system 1010 so that each bottle 1040 traverses the various stations, for example, the bottle gripping station (not shown) and the bottle cleaning system 1020. The conveyor arrangement 1012 transfers the bottles 1040 so the bottle flow path follows the direction of the arrows, and as a result of the bottle path passing around a large pulley rotating wheel 1014, the bottles 1040 become inverted in a generally upside down position with the opening being downwardly directed, as shown by bottle 1040 in FIG. 15. The bottles 1040 are preferably held in the conveyer arrangement by the finger grippers 1039 (shown in FIG. 16A). As the bottles 1040 pass through the cleaning system 1020, air is directed inside the bottles 1040 by the nozzles 1301 on the nozzle array 1300. This has the effect of discharging any particles located inside the bottles 1040. The pressure of the air exiting the nozzles can be regulated at the air source and can be manipulated by any suitable methods known in the art. It may be desired to customize the pressure of the air based on the type and/size of the bottle being cleaned.

The vacuum system 1100, which continually evacuates the air within the housing 1022, evacuates any floating ionized dust or other particles that have been removed from the bottles 1040. Consequently, tiny particles that have been displaced from the bottle surfaces that remain entrained in the air within housing 1022 are evacuated from the bottle environment and are no longer available to re-adhere to the surface again in the event they become de-ionized. Additionally, the vacuum can be applied such that a negative pressure is maintained across the system. This helps prevent dirty air from being blown into the environment surrounding the system and prevents the dirty air from contaminating the surrounding environment and equipment.

The container rinsing system of the present disclosure provides several advantages. The container rinsing system utilizes much less electric energy than traditional air systems (less than half of the electric energy) to air rinse empty bottles. It is robust, leads to less down time of the bottling operation, and requires less maintenance than preexisting systems.

Additionally, because the system is an air-only system as opposed to a water-based system or combination air/water system, the system uses fewer natural resources such as water and electricity. The rinsing system also has a small footprint saving on facility space. Previous designs required a larger footprint and more structure and components. The design also allows the nozzles to be positioned closer to the bottle finish enhancing rinsing capabilities. Because the system components, including the housing and conveyor, can be easily adjusted, rapid change-over of the system is achieved for differently-sized bottles. Use of the ionizing air nozzle neutralizes electrostatic charges both on inside and outside surfaces of the containers. Overall, because of its simplified structure and operation, the rinsing system is less expensive to fabricate, operate and maintain.

In any of the above embodiments, if either of the sensors connected to the vacuum members or the nozzles senses a lack of suction or a lack of air pressure respectively, the system is automatically shut down via an automatic shut-off switch.

Given the benefit of the above disclosure and description of exemplary embodiments, it will be apparent to those skilled in the art that numerous alternative and different embodiments are possible in keeping with the general principles of the invention disclosed here. Those skilled in this art will recognize that all such various modifications and alternative embodiments are within the true scope and spirit of the invention. The appended claims are intended to cover all such modifications and alternative embodiments. It should be understood that the use of a singular indefinite or definite article (e.g., "a," "an," "the," etc.) in this disclosure and in the following claims follows the traditional approach in patents of meaning "at least one" unless in a particular instance it is clear from context that the term is intended in that particular instance to mean specifically one and only one. Likewise, the term "comprising" is open ended, not excluding additional items, features, components, etc.

What is claimed is:

1. A method for assembling an air rinsing system for containers comprising:

providing an air source for use in rinsing the containers;

connecting a manifold to the air source, the manifold comprising a top surface, a bottom surface, and side surfaces, a manifold inlet, and an ionization unit;

positioning manifold outlet on either the top surface or the bottom surface, or on a side surface on the manifold for directing air from the air source at the containers to aid in removing debris from the containers; and placing the ionization unit in a volume defined by the top surface, the bottom surface, and the side surfaces within the manifold such that when air is supplied to the manifold during operation, the air is ionized within the manifold and during operation air is ionized before exiting the manifold outlet.

2. The method of claim 1 further comprising providing a vacuum system for the removal of particles.

3. The method of claim 2 further comprising providing the vacuum system to maintain a negative pressure in the container rinsing system.

4. The method of claim 2 wherein the container rinsing system is configured to recycle air from the vacuum system to the air source.

5. A container rinsing system comprising:

an air source; and a manifold connected to the air source, the manifold comprising a top surface, a bottom surface, and side surfaces, a manifold inlet, an ionization unit, and a plurality of outlets positioned on either the top surface or the bottom surface or on a side surface;

wherein the ionization unit is placed in a volume defined by the top surface, the bottom surface, and the side surfaces within the manifold and the plurality of nozzles are located on the manifold such that during operation air is ionized before exiting the manifold.

6. The container rinsing system of claim 5 further comprising a vacuum system for removal of particles.

7. The container rinsing system of claim 6 wherein the vacuum system is configured to maintain a negative pressure in the container rinsing system.

8. The container rinsing system of claim 7 wherein the container rinsing system is configured to recycle air from the vacuum system to the air source.

* * * * *